United States Patent [19]

Goff

[11] 4,075,829

[45] Feb. 28, 1978

[54] SELF-CONTAINED MINIATURE TIMER

[75] Inventor: Mark D. Goff, Dallas, Tex.

[73] Assignee: GRS Instruments, Inc., Dallas, Tex.

[21] Appl. No.: 695,191

[22] Filed: Jun. 11, 1976

[51] Int. Cl.[2] ..... G04B 47/00; G04F 7/04; A47F 7/00

[52] U.S. Cl. ..... 58/152 T; 58/39.5; 58/56; 58/74; 58/145 K; 235/92 PE; 248/115; 324/186

[58] Field of Search ..... 58/38, 39.5, 23 AC, 58/21.13, 52–56, 74, 145 K, 152 T; 248/114, 115, 205 A, 206 R; 235/92 PE, 92 E, 92 A, 92 T; 324/186

[56] References Cited

U.S. PATENT DOCUMENTS

| | | | |
|---|---|---|---|
| 1,113,538 | 10/1914 | Braucher et al. | 58/56 |
| 1,136,520 | 4/1915 | Fukami | 58/56 |
| 1,371,079 | 3/1921 | Drosin | 248/115 |
| 2,169,183 | 8/1939 | Fish | 248/206 R |
| 2,609,045 | 9/1952 | Kaiser | 58/145 R |
| 2,633,440 | 3/1953 | Scholl | 248/205 A |
| 3,410,513 | 11/1968 | Wolf | 248/205 A |
| 3,517,636 | 6/1970 | Morales | 58/39.5 |
| 3,686,880 | 8/1972 | Samejima | 58/74 |
| 3,756,694 | 9/1973 | Soree | 350/160 LC |
| 3,765,163 | 10/1973 | Levin et al. | 58/50 R |
| 3,789,600 | 2/1974 | Champan | 58/39.5 |
| 3,824,782 | 7/1974 | Iinuma | 58/85.5 |
| 3,899,872 | 8/1975 | Flumm et al. | 58/125 C |
| 3,950,935 | 4/1976 | Naito | 58/39.5 |
| 3,965,669 | 6/1976 | Larson et al. | 58/39.5 |
| 3,998,045 | 12/1976 | Lester | 58/23 R |

FOREIGN PATENT DOCUMENTS

| | | | |
|---|---|---|---|
| 423,469 | 2/1935 | United Kingdom | 58/56 |

*Primary Examiner*—Edith S. Jackmon
*Attorney, Agent, or Firm*—Richards, Harris & Medlock

[57] ABSTRACT

The specification discloses a timer including a housing having a display aperture in the front surface thereof. A light emitting diode display is mounted within the display aperture for displaying multiple digits. A U-shaped bracket pivotally connects to the housing and has a base surface which is adapted to be attached to a telephone set for ease of viewing by the telephone user. Timing circuitry within the housing generates periodic timing signals and drives the display to display time intervals to the telephone user. A switch is positioned on the housing for actuation by the telephone user to start and stop operation of the circuitry.

16 Claims, 6 Drawing Figures

SELF-CONTAINED MINIATURE TIMER

FIELD OF THE INVENTION

This invention relates to timing devices, and more particularly relates to a self contained-miniaturized timer particularly useful for telephone sets to time telephone calls.

THE PRIOR ART

Electronic timing devices have long been used to provide various timing functions. However, one function which has not heretofore been practically fulfilled is the timing of telephone conversations. In particular, for long distance telephone conversations, a predetermined interval of time, for example 3 minutes, is provided for a set fee to make the call. If the conversation extends past the prealloted time, an additional charge is incurred. Most telephone charges are thus stated in elapsed minutes. Moreover, many telephone systems utilize pre-leased telephone lines wherein a plurality of hours of telephone conversation are provided at a fixed cost. However, additional costs are incurred when the prealloted number of hours is used. A need has thus arisen for a miniaturized, self-contained timer which provides an easily visible digital indication of a telephone time interval. Such a timing device should be essentially maintenance free and able to be easily placed for observance by the telephone user, without cluttering up a desk or the like.

SUMMARY OF THE INVENTION

In accordance with the present invention, a miniaturized timer is provided which substantially meets the requirements for a practical self-contained timer for use for timing telephone conversations or other events.

In accordance with the present invention, a telephone set timer includes a housing having a display aperture in the front surface thereof. A display is mounted within the display aperture for displaying multiple digits. A bracket is pivotally connected to the housing and has a base surface. Adhesive or the like is provided to attach the base surface to a surface of a telephone set, such that the display may be observed by the telephone user. Timing circuitry within the housing generates periodic timing signals and drives the display to display time intervals to the telephone user. A switch is positioned on the housing for actuation by the telephone user to start and stop and reset the operation of the circuitry.

In accordance with another aspect of the invention, a timing unit includes a housing with a display on the housing for displaying indications of time intervals. Timing circuitry within the housing drives the display. A rocker switch is mounted in the housing and is pivotal between first and second positions. A support wall member within the housing is provided to support a conductive pin therein. A conductive spring member is connected at one end of the wall member and has a free end movable by the switch between open and closed positions. A conductive pin includes an end portion mounted adjacent the free end of the spring member, wherein the spring member is normally spaced from the pin in the open position and is pressed against the pin in the closed position.

In accordance with yet another aspect of the invention, a timer display unit includes a housing having a display screen. The display screen includes multi-segment display units and a decimal display unit. Timing circuitry generates timing signals. Circuitry is responsive to the timing signals for generating a digit driving signal and a segment select signal for driving a display screen to display a plurality of munerical digits representative of elapsed time. A pair of series connected inverters is coupled at the junction thereof to the decimal display unit. The digit driving signal is applied to the input of the inverters. The digit select signals are applied to the output of the inverters. A switch on the housing actuates and terminates operation of the timing circuitry in order to display representations of elapsed time.

DESCRIPTION OF THE DRAWINGS

For a more detailed description of the preferred embodiment, and for further objects and advantages thereof, reference is now made to the following description, taken in conjunction with the accompanying drawings, in which.

DESCRIPTION OF THE PREFERRED EMBODIMENT

Figure 1:
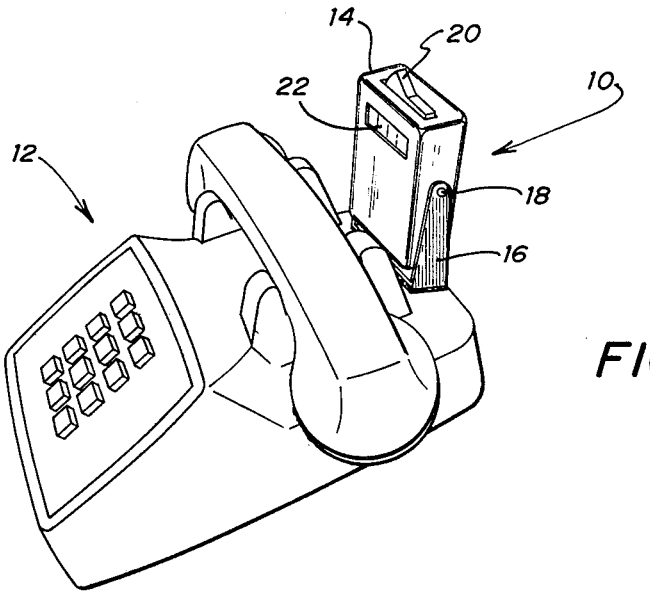
FIG. 1 is a perspective view of the present telephone timer shown attached to the rear of a conventional telephone set.

Referring to FIG. 1, the present telephone timing device is designated generally by the numeral 10 and is shown attached to a conventional telephone set 12. The telephone timer 10 comprises a rectangular plastic housing 14 pivotally supported by a U-shaped support bracket 16. The bracket 16 is attached to a rear surface of the telephone 12 in the manner illustrated by the use of an adhesive such as a double sided foam tape, suction cups or by any other suitable attaching technique. The housing 14 is connected at pivots 18 to opposite sides of the bracket 16 to enable pivoting of the housing for easy viewing by the user of the telephone set 12.

Housing 14 includes a rocker switch 20 on the top thereof to enable the timing mechanism within the housing to be turned on or off. An aperture 22 is formed in the front face of the housing 14 in order to present a visual numeric readout of the time being consumed by a particular telephone call being made on the telephone set 12.

In operation of the present device, when the user of the telephone set 12 begins a telephone call which is to be timed, such as a long distance call, the telephone user operates the rocker switch 20. This initiates operation of timing circuitry within the timer 10 and the time interval is displayed at aperture 22 in minutes and tenths of minutes. When the telephone user sees that a predetermined number of minutes or tenths of minutes have passed, he may terminate his call if desired. When the call is terminated, the user may record the time interval displayed on the timer 10 in order to provide timing information for billing purposes.

It is understood that the timer 10 is useful for other time keeping operations, such as for cooking and for other activities. The timer, when used in other activities, may be removed from the bracket 16 and reattached to another bracket or carried in a pocket for other timing uses.

Figure 2:
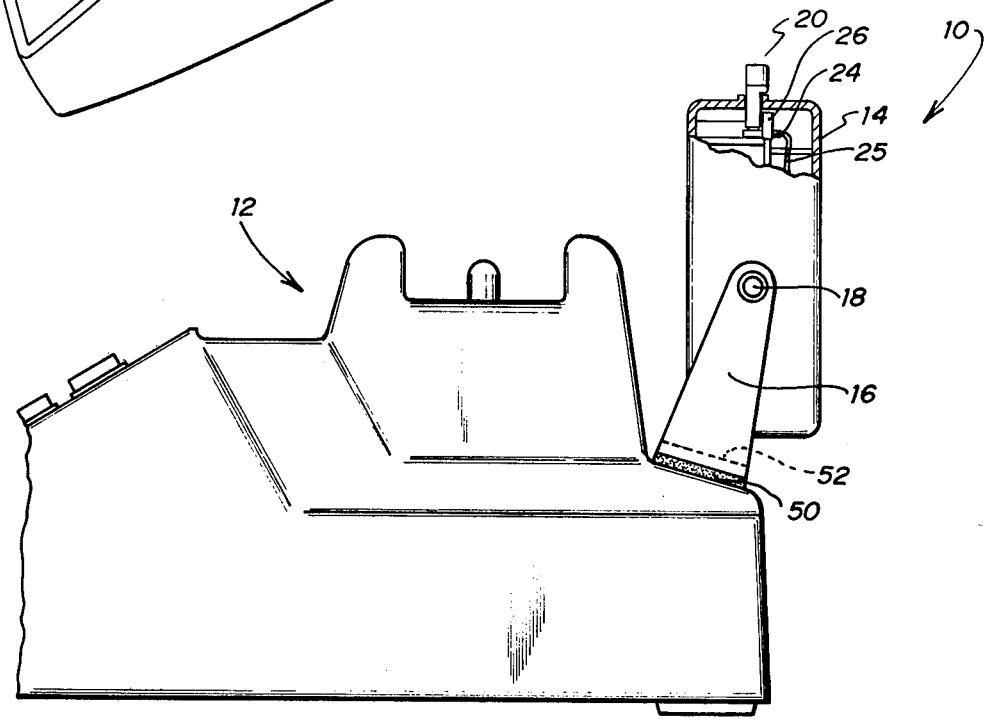
FIG. 2 is a side view of the timer and set shown in FIG. 1, partially broken away for ease of illustration.
Figure 3:
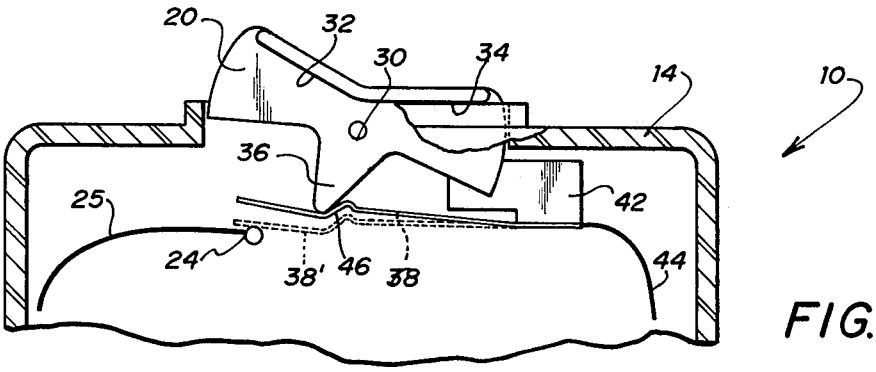
FIG. 3 is a partially broken away sectional view of the top of the present timer.

FIGS. 2 and 3 illustrate the switch mechanism of the present invention in greater detail. An important aspect of the present invention is that the switch is quite inexpensive to manufacture and yet provides essentially maintenance-free operation while providing good electrical operating characteristics. The switch also provides a wiping action against a fixed pin to prevent accumulation of debris or the like. A gold plated contact pin 24 is mounted through an insulating wall 26 which forms a portion of the interior of the housing 14. Pin 24 is connected to the battery via wire 25. When the switch is closed electrical power from batteries located in the housing 14 is supplied to the pin 24 and is applied to the timing circuitry through electrical wire 25.

Referring to FIG. 3, it will be seen that the rocker switch 20 is pivoted about a pivot pin 30 mounted within the housing 14. The rocker switch 20 includes a first surface 32 and a second surface 34. Depression of surface 32 pivots the rocker switch 20 about pivot 30 to place the switch in the "On" position. Depression against surface 34 pivots the rocker switch 20 to the "Off" position.

The rocker switch 20 includes a lower projection 36 which bears against a flexible metallic spring 38. Spring 38 is integrally formed from and extends from a plate 42. Plate 42 is connected to an insulating wall within housing 10. An electrical wire 44 is attached to the metallic spring 38 and interconnects with a second terminal of the battery within the housing 14.

When the rocker switch 20 is in the position illustrated in FIG. 3, the projection 36 allows the spring 38 to rest in a position out of contact with the pin 24. The spring 38 in this position exerts upward tension against switch 20 to prevent loosening of the switch. When the surface 32 is depressed, the projection 36 bears against portion 46 of the spring 38, which acts as a detent, and forces the spring 38 to the dotted line position 38' to bear against the pin 24. This action creates a wiping movement which cleans the contacts. This completes the electrical connection and applies current to the timing circuitry of the present invention in order to initiate the timing operation thereof.

Further referring to FIG. 2, it will be seen that the U-shaped bracket 16 is attached to a surface of the telephone set 12 by an adhesive layer 50. It will be understood that the U-shaped bracket 16 includes two identical bracket arms 16 integrally connected on opposite sides of a base portion 52 which is connected to the adhesive 50.

Figure 4:
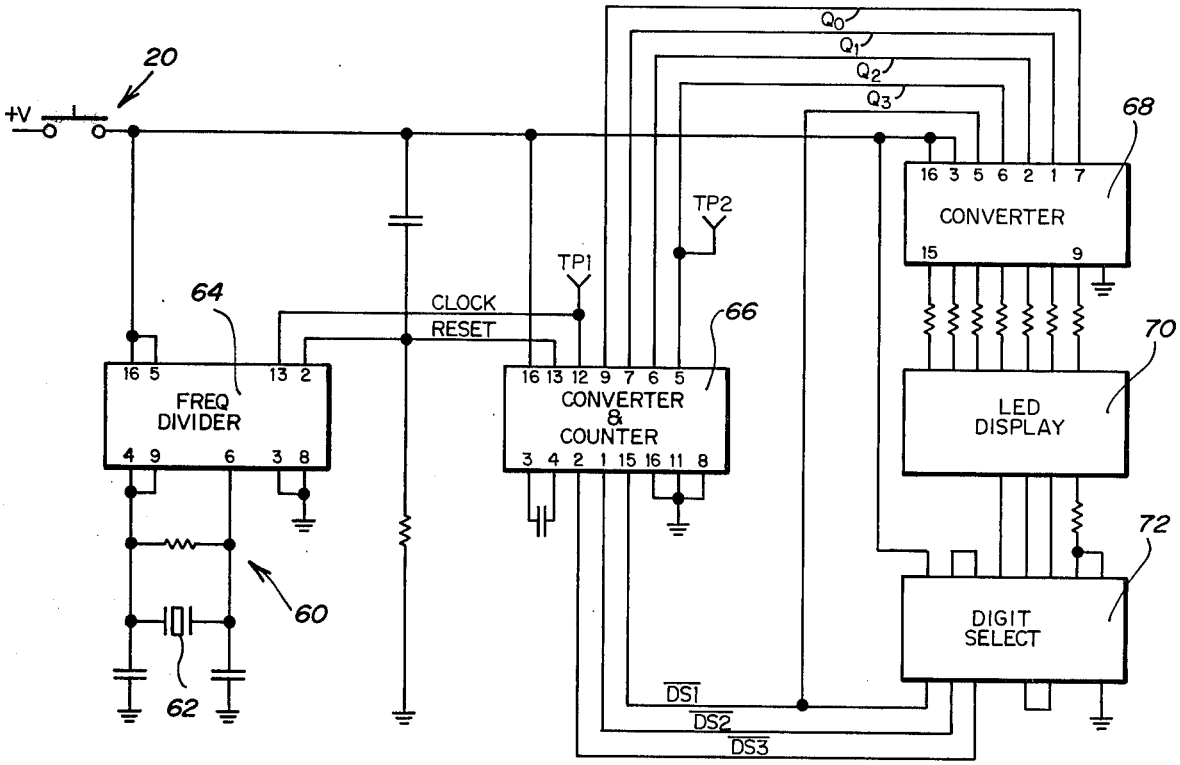
FIG. 4 is a schematic diagram of the timing circuitry of the present timer.

FIG. 4 illustrates in schematic detail the timing circuitry of the present invention. A frequency source 60 comprises a piezoelectric ceramic resonator 62 which operates in conjunction with a pi network comprising capacitors and resistors to generate a standard frequency of 349.5 kHz. The use of the ceramic resonator 62 is important, in that the resonator is much less expensive than a conventional quartz crystal frequency source, but is more accurate than a conventional R-C network. As is known, a ceramic resonator is a resonant or antiresonant device commonly used in filtering techniques. A suitable ceramic resonator is the VTFA resonator manufactured and sold by Vernitron Piezoelectric Division of Bedford, Ohio.

The frequency generated by the frequency source 60 is applied to the frequency divider 64, which may comprise for example an MC14521CP chip manufactured and sold by Motorola Semiconductor Corporation of Phoenix, Ariz. The frequency divider 64 divides a clock frequency into lower frequency signals which are applied to clock a converter and counter circuit 66, which may comprise for example an MC14553CP chip manufactured and sold by Motorola Semiconductor Corporation. The reset signal resets the frequency divider 64 and counter 66 each time the power "On" is reset. The converter and counter 66 operate as a three stage BCD counter to generate control signals for the display unit. The frequency of the multiplexing of the display is controlled by the capacitor connected between pins 3 and 4 of counter 66. Pins 9, 7, 6 and 5 of counter 66 generate signals Q0–Q3 which are applied to a BCD to seven segment converter 68, which may comprise for example an MC14558CP circuit manufactured and sold by Motorola Semiconductor Corporation. The converter 68 converts the BCD output Q0–Q3 to seven sigment display control signals which are applied to a light emitting diode (LED) seven segment display 70. The LED display may comprise for example a HP 5082-7433 three digit display manufactured and sold by Hewlett Packard of Palo Alto, Calif.

The counter 66 generates digit select signals $\overline{DS1}$-$\overline{DS3}$ which are applied to a digit select circuit 72. Digit select circuit 72 may comprise for example an MC14049CP chip manufactured and sold by Motorola Semiconductor Corporation.

In operation of the circuitry shown in FIG. 4, the converter and digit select circuit 72 operates to select the digits which are selectively displayed on the LED display 70 in order to display minutes and tenths of minutes on the display. Each digit which is displayed is turned on 33⅓ of the time and is turned off 66⅔ of the time in order to save battery power. Another important aspect of the invention is that the most significant leading digit is blanked if it is zero to prolong battery life. A circular polarized lens is disposed over each of the digits of the LED display 70 in order to allow easy visibility of the timer in high light environments.

Figure 5:
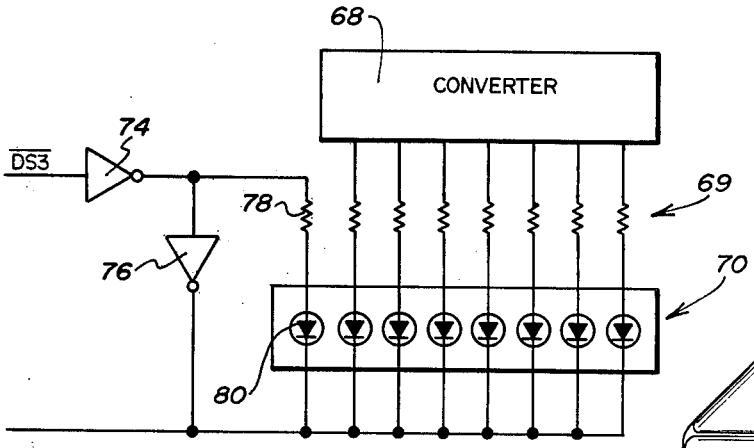
FIG. 5 is a schematic diagram of a portion of the digit select circuitry of the invention.

Another important aspect of the invention is a portion of the circuitry of the digit select 72 is utilized to drive the decimal point of the display in a unique manner. FIG. 5 illustrates in schematic detail the interconnection of the converter 68 through resistors 69 to a LED unit 70. The remaining two LED units are not shown in FIG. 5. A pair of inverters 74 and 76 are included in the digit select 72 and are connected in series in the manner illustrated. A resistor 78 is tied to a juncture of the inverter 74 and is connected to the anode of LED 80. The cathode of LED 80 is connected to digit select 3 common. With this circuit, when $\overline{DS3}$ is selected, the digit select signal $\overline{DS3}$ is twice inverted in order to pick up increased drive power but still is provided with the same phase at the output as in the input. By driving off the middle of the inverters, a plurality of required driving transistors are eliminated. In this manner, the select for the last LED is utilized for the decimal point and for the least significant digit.

Another important aspect of the present invention is a display test function provided by applying 4 volts to test point 1 (TP1) and test point 2 (TP2). This disables counter 66 and forces a BCD"8" condition to converter 68 to force all three digits of the LED display 70 to all "eights" in order to verify that all of the segments of the LEDs are working correctly.

Figure 6:
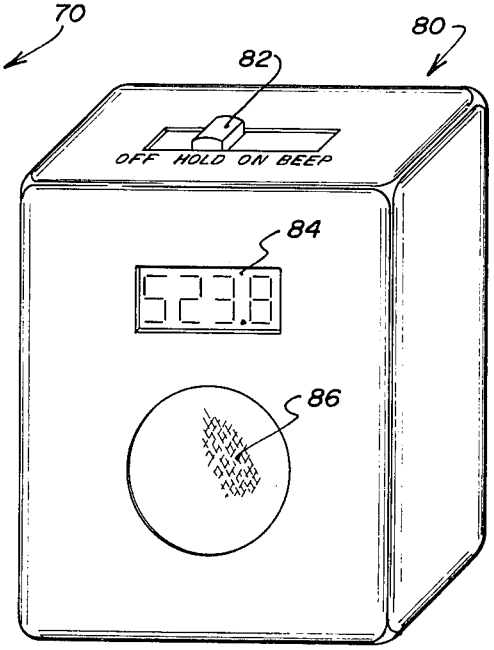
FIG. 6 is a perspective view of a second embodiment of the timer.

FIG. 6 illustrates another embodiment of the present invention which would be particularly useful for WATS line timing and the like. In this device, a housing 80 is provided with a generally rectangular configuration and includes a four position switch 82 which may be movable between "Off," "Hold," "On" and "Beep" positions. A display 84 includes four LEDs in order to provide a display of up to 999.9 minutes of accumulated time. An audible signal generator 86 is provided to generate periodic sound indications of time.

In this embodiment, when the switch 82 is placed in the "Hold" position, the sequential intervals of time are accumulated on the display 84 in order to provide an indication of the total number of hours/minutes utilized on the WATS line. When the switch 82 is moved to the "On" position, time is recorded at the display 84 only for the one call being timed. When the swtich 82 is moved to the "Beep" position, an audible beep is generated through the device 86 for each minute interval. In this manner, the telephone operator is provided with a sound indication as the minutes occur.

It will thus be seen that the present invention provides a unique timer which is particularly adapted for timing calls on telephone sets. If it is desired, the timer may be removed from the U-shaped bracket and the timer utilized as a pocket timer to time sports events and the like. It will be understood that various types of circuitry can be utilized with the present invention, including CMOS, MOS, PMOS, ECL, TTL, $I^2L$, micro-processors and the like.

Whereas the present invention has been described with respect to specific embodiments thereof, it will be understood that various changes and modifications will be suggested to one skilled in the art, and it is intended to encompass such changes and modifications as fall within the scope of the appended claims.

What is claimed is:

1. A telephone set timer comprising:

a housing having a display aperture in the front surface thereof, display means mounted within said display aperture for displaying multiple digits, a bracket having a base surface connected to upwardly extending arms, pivot means on said arms for connecting said housing between said arms for enabling the attitude of said housing to be adjusted pivotally to any one of a number of fixed positions relative to the telephone set to facilitate viewing of said display by a telephone user, means for attaching said base surface to a surface of a telephone set such that said display means may be observed by the telephone user, timing circuitry within said housing for generating periodic timing signals and for driving said display means to display time intervals to the telephone user, and switch means positioned on said housing for actuation by the telephone user to start and stop operation of said circuitry in order to provide an indication of the time of telephone calls by the user.

2. The telephone set timer of claim 1 wherein said base surface is adapted to be horizontally disposed adjacent the telephone set, said means for attaching comprises adhesive disposed between said base surface and the telephone set.

3. The telephone set timer of claim 2 wherein said adhesive comprises suction cup means.

4. The telephone set timer of claim 2 wherein said adhesive comprises a double sided foam tape.

5. The telephone set timer of claim 1 and further comprising:

audio means in said housing for generating an audible signal in a periodic manner.

6. The telephone set timer of claim 1 and further comprising means for accumulating and displaying the total time intervals between plural operations of said switch means.

7. A timing unit comprising:

a housing, display means on said housing for displaying indications of time intervals, timing circuitry within said housing for driving said display means, structure forming a fixed axis, a support wall member within said housing supporting said fixed axis, a rocker arm mounted in said housing and pivotable between a first position and a second position about said fixed axis, plunger means attached to said rocker arm and pivoting between the first position and the second position through an arc about said fixed axis, a conductive spring member comprising two offset planar parallel portions connected end to end by an inclined portion of the spring, said spring member connected at one end to said wall member and having a free end movable by said plunger means between open and closed positions, and a conductive pin mounted through said wall member and having an end portion mounted adjacent said free end of said spring member, wherein said spring member is normally spaced from said pin in said open position and is pressed against said pin with a wiping action in said closed position.

8. The timing unit of claim 7 wherein said display means comprises seven-segment display units for displaying minutes and tenths of minutes.

9. The timing unit of claim 7 wherein said circuitry comprises a ceramic resonator operable as a frequency source to provide timing.

10. The timing unit of claim 7 wherein said display means generates minute and tenth of minute indications separated by a decimal, and means for blanking the display of the most significant digit when it is zero.

11. A timing unit comprising:

a housing, a plurality of seven-segment light emitting diodes for displaying digits indicating a time interval, one of said diodes operable to display a decimal, means for generating a digit driver signal for said one diode, a pair of series connected inverters for receiving said digit driver signal at the input thereof, said one diode coupled to the junction of said inverters, a digit select signal for being applied to the output thereof, a switch mounted in said housing and pivotable between first and second positions, a support wall member within said housing, a conductive spring member connected at one end to said wall member and having a free end movable by said switch between open and closed positions, and a conductive pin mounted through said wall member and having an end portion mounted adjacent said free end of said spring member, wherein said spring member is normally spaced from said pin in said open position and is pressed against said pin with a wiping action in said closed position.

12. A timer display unit comprising:

a housing having a display screen, said display screen having multi-segment display units and a decimal display unit, timing circuitry for generating timing signals, circuitry responsive to said timing signals for generating a digit driving signal and segment select signals for driving said display screen to display a plurality of numerical digits representative of elapsed time, a pair of series connected inverters, said decimal display unit coupled between the junction of said inverters and the output of said inverters, said digit driving signal being applied to the input of said inverters, said digit select signals being applied to the output of said inverters, and switch means on said housing for actuating and terminating operation of said timing circuitry in order to display representations of elapsed time.

13. The timer display unit of claim 12 wherein said display means comprises seven-segment display units for displaying minutes and tenths of minutes.

14. The timer display unit of claim 12 and further comprising:

circular polarized lens over said display means.

15. The timer display unit of claim 12 wherein said switch means comprises a pivotable rocker switch, said switch including a flexible switch arm movable against a stationary conductor pin to complete an electrical circuit to actuate said timing circuitry.

16. The timer display unit of claim 12 wherein said circuitry comprises a ceramic resonator operable as a frequency source to provide timing.

* * * * *